United States Patent [19]

Patil

[11] 4,375,371

[45] Mar. 1, 1983

[54] METHOD FOR INDUCTION MELTING

[75] Inventor: Balaji V. Patil, Sarver, Pa.

[73] Assignee: Allegheny Ludlum Steel Corporation, Pittsburgh, Pa.

[21] Appl. No.: 273,128

[22] Filed: Jun. 12, 1981

[51] Int. Cl.[3] ..... C21C 5/52; C22B 4/00

[52] U.S. Cl. ..... 75/10 R; 75/11; 75/12

[58] Field of Search ..... 75/10–12

[56] References Cited

U.S. PATENT DOCUMENTS 3,443,935 5/1969 Lipp ..... 75/10 R

*Primary Examiner*—P. D. Rosenberg

*Attorney, Agent, or Firm*—Patrick J. Viccaro

[57] ABSTRACT

A method for induction melting wherein the formation of high melting temperature refractory oxides formed by the reaction of one or more of the raw materials being melted with oxygen is avoided by the introduction of boron.

12 Claims, No Drawings

METHOD FOR INDUCTION MELTING

In applications such as the thermostatic alloy market it is known to produce manganese-copper-nickel alloys by induction melting to produce ingots which may then be remelted by conventional practice for this purpose, such as electroslag melting. A specific conventional alloy for this purpose would contain nominally 72% manganese, 18% copper and 10% nickel, which grade is referred to as AL-772. During melting of this alloy and alloys of this type the manganese in the charge material, which is typically electrolytic manganese has a high oxygen content which typically may be of the order of 2000 ppm. In conventional practice, during melting this oxygen combines with manganese to form the highly refractory manganese oxides having melting points higher than 2100° to 2300° F. normally used for melting of the alloy AL-772. This manganese oxide is present during induction melting in the form of solid particles that float on top of the melt. This impairs sampling of the melt and melt temperature measurement and more importantly causes difficulties during tapping of the induction melted heat. Specifically, the manganese oxide particles during tapping block tundish nozzles, trap within the oxide particles valuable metallics from the melt and require mechanical means for removal of the excessive buildup from the furnace between heats. The use of conventional deoxidizers, such as aluminum, silicon or calcium, to combine with the oxygen was not successful. The use of deoxidizers of this type cause the formation of highly refractory oxides that are solid at the induction melting temperatures of 2100° to 2300° F. and cannot flux the manganese oxides.

It is accordingly a primary object of the invention to prevent the buildup of oxides and entrapment of metallics by the highly refractory oxides during induction melting of alloys of the aforementioned type.

It is another more specific object of the invention to prevent the buildup and entrapment of metallics by the highly refractory manganese oxides during induction melting of manganese-copper-nickel alloys of the aforementioned type by the introduction of boron to the melt to combine with part of all of the oxygen present in the raw material charge.

In accordance with the invention boron is added to the melt and the boron addition combines with part of the oxygen present to form boron ($B_2O_3$) oxide. The boron oxide formed will remain liquid and also form a low melting liquid with manganese oxides, generally known as the fluxing action, at the typical induction melting temperature of 2100° to 2300° F. used for alloys of this type. Consequently, the formation, buildup and entrapment of metallics by the highly refractory oxides characterizing prior art induction melting practices is avoided. More specifically with respect to the addition of boron it has been found to be effective in amounts of at least 0.02% by weight of the charge for induction melting. A preferred range would be 0.02 to 0.10% by weight with a more preferred lower limit of 0.03 and an upper limit of 0.06% by weight. The source of boron preferred is elemental boron but it can be added in the form of an oxide or a boron-containing alloy or any other compound of boron which can form the $B_2O_3$ and form a low melting liquid with manganese oxide, that is, flux the refractory oxides. In induction melting of alloy charges having oxygen contents greater than 100 ppm, boron has been effective in avoiding the formation of undesirable highly refractory oxides and associated buildup and entrapment of metallics. The practice of the invention is useful in both vacuum induction and air induction furnace practices as well as practices involving the use of a protective atmosphere such as argon, helium, nitrogen, hydrogen and mixtures thereof. Generally, the melting practice with which the invention is used may involve melting in atmospheres from about 1 mm of Hg to about atmospheric pressure. In combination with a boron addition, deoxidizers such as aluminum, silicon, calcium or mixtures thereof may be used but are not necessary for melting of AL-772.

As a specific example of the invention and to demonstrate the effectiveness thereof, two series of manganese-copper-nickel alloy heats were produced. The first series comprised five heats and the second series four heats. The melting parameters for these heats, including the boron addition thereto, are set forth in Table I.

TABLE I

ALLOY AL-772

VIM MELTING PARAMETERS FOR HEATS WITH BORON ADDITION

| | | | Additions, Wt. Pct. | | | Temperatures** | | |
|---|---|---|---|---|---|---|---|---|
| Heat No. | Crucible | Melt No. | Al | Ca | Boron | Just After Meltdown °C.(°F.) | Just Before Tapping °C.(°F.) | Product |
| FIRST SERIES OF HEATS | | | | | | | | |
| RV7796 | #5 | 1 | 0.10 | 0.12 | 0.06 | 1249 (2280) | 1249 (2280) | Ingot |
| RV7797 | #5 | 2 | 0.10 | 0.12 | 0.03 | 1277 (2330) | 1248 (2280) | Ingot |
| RV7798 | #5 | 3 | 0.25 | 0.10 | None* | 1268 (2315) | 1243 (2270) | Ingot |
| RV7807 | #5 | 4 | 0.10 | 0.12 | 0.02 | 1249 (2280) | 1243 (2270) | Electrode |
| RV7808 | #5 | 5 | 0.30 | None | None | 1243 (2270) | 1260 (2300) | Electrode |
| SECOND SERIES OF HEATS | | | | | | | | |
| RV7954 | #6 | 5 | None | None | 0.06 | 1266 (2310) | 1232 (2250) | Ingot |
| RV7955 | #6 | 6 | None | None | 0.10 | 1249 (2280) | 1238 (2260) | Electrode |
| RV7956 | #6 | 7 | 0.10 | 0.12 | 0.03 | 1271 (2320) | 1249 (2280) | Electrode |
| RV7957 | #6 | 8 | 0.10 | 0.12 | 0.06 | 1260 (2300) | 1238 (2260) | Electrode |

*In Heat RV7798, $BaF_2$ (0.04%) and $CaF_2$ (0.017%) were added.

**Actually temperatures were measured in °F. and then calculated in °C.

The metallurgical composition of these heats is set forth in Table II.

TABLE II

ALLOY AL-772 (P)
CHEMISTRY OF VIM INGOTS OR ELECTRODES (BUTT END)

| Heat No. | Ingot (I) or Electrode (E) | Mn | Cu | Ni | Al | Fe | Ca | B | $O_2$ | $N_2$ | $H_2$ | Mg |
|---|---|---|---|---|---|---|---|---|---|---|---|---|
| | | In Weight Percent | | | | | In Parts Per Million | | | | | |
| FIRST SERIES OF HEATS | | | | | | | | | | | | |
| RV7796 | I | 71.33 | 18.02 | 10.04 | 0.015 | N.A. | 23 | 276 | 215 | 33 | 5.3 | 3 |
| RV7797 | I | 71.62 | 17.95 | 10.04 | 0.005 | N.A. | 2 | 109 | 320 | 15 | 4.3 | 3 |
| RV7798 | I | 71.69 | 18.02 | 10.02 | 0.010 | N.A. | 2 | 38 | 212 | 20 | 4.0 | 2 |
| RV7807 | E | 71.57 | 18.06 | 10.07 | 0.005 | N.A. | <10 | 63 | 265 | 18 | N.A. | <10 |
| RV7808 | E | 71.76 | 17.88 | 10.12 | 0.010 | N.A. | <10 | 50 | 180 | 21 | N.A. | <10 |
| SECOND SERIES OF HEATS | | | | | | | | | | | | |
| RV7954 | I | 71.76 | 18.02 | 10.10 | <0.001 | 0.41* | <10 | 250 | 227 | 17 | 4.8 | N.A. |
| RV7955 | E | 71.47 | 17.82 | 9.98 | <0.001 | 0.52* | <10 | 320 | 287 | 12 | 4.2 | N.A. |
| RV7956 | E | 71.03 | 18.37 | 10.22 | <0.001 | 0.17 | <10 | 20 | 178 | 13 | 4.7 | N.A. |
| RV7957 | E | 71.36 | 18.06 | 10.04 | <0.001 | 0.33 | <10 | 90 | 194 | 17 | 5.0 | N.A. |

*This high iron content would be due to addition of boron as ferroboron.
N.A. — Not analyzed.

With respect to the heats to which boron was added it was in the form of ferroboron (17% boron) and the heats to which calcium was added, calcium was in the form of a nickel-calcium alloy (5% calcium).

As the first series of melts a vacuum induction melting practice was used wherein the furnace was initially pumped down to 800 microns and then back-filled with 250 mm of argon. The charge was melted at a temperature of approximately 2100° to 2300° F. at which point samples were taken for analysis. After meltdown, the charge was held in the furnace for about 20 minutes and then cast into either typical cast iron ingot molds or electrode molds. The electrodes were then electroslag remelted using a slag of 70 weight percent $BaF_2$ and 30 weight percent $CaF_2$. Further with respect to this first series of heats specific Heats RV7796 and RV7797 which were melted with 0.06% and 0.03% boron, respectively, in addition to 0.10% aluminum and 0.12% calcium additions resulted in little detectable buildup in the melting crucible. Heat RV7798 was melted with additions of aluminum, calcium and $BaF_2+CaF_2$ additions and exhibited some refractory oxide formation and buildup in the crucible. Heat RV7807 was melted using 0.02% boron with aluminum and calcium additions. This heat exhibited less oxide formation than RV7798 thus indicating the effectiveness of the 0.02% boron addition. Heat RV7808 with an addition of 0.30% aluminum only exhibited significant refractory oxide formation in the crucible. The qualitative examination of the crucible from the standpoint of refractory oxide formation with respect to this series of heats showed boron to be effective in amounts as low as 0.02%.

With respect to the second series of heats, the only addition with regard to Heats RV7994 and RV7955 was boron in the amount of 0.06% and 0.10%, respectively. Examination of the crucible with respect to both of these heats showed essentially no buildup and no refractory oxide formation. Heats RV7956 and RV7957 wherein additions of aluminum and calcium were made in combination with boron likewise showed essentially no buildup and refractory oxide formation in the crucible. Specifically, the total estimated buildup and oxide formation for heat RV7956 was 2.6% of the total charge and that for RV7957 was 3.6%. In many commercial VIM heats where boron was not used we had experienced loss of 10 to 15% metallics due to buildup and entrapment of metallics by the refractory oxides.

The term "boron" as used herein means any source of boron effective for the purpose, including boron-containing alloys and oxides as well as elemental boron.

I claim:

1. A method of melting an alloy in an induction furnace, comprising charging an induction furnace with metallic raw materials of generally elemental metallics, at least a portion of which contain greater than 100 ppm of oxygen in any form, charging said induction furnace with boron in any form in an amount of at least 0.02% by weight of the total charge, melting said charge materials in said induction furnace and thereafter pouring the melt from the furnace into a mold for solidification and formation of an ingot.

2. The method of claim 1 wherein the furnace is a vacuum induction furnace.

3. The method of claim 1 wherein the furnace is an air induction furnace.

4. The method of claim 1 wherein melting is conducted in a protective atmosphere.

5. The method of claim 4 wherein the protective atmosphere is a gas selected from the group consisting of argon, helium, nitrogen, hydrogen and mixtures thereof.

6. The method of claim 1 wherein melting is conducted at a pressure of from about 1 micron to about atmospheric pressure.

7. The method of claim 1 wherein deoxidizers selected from the group consisting of aluminum, silicon, calcium and mixtures thereof are introduced to the furnace and melted with the charge material.

8. The method of claim 1 wherein the amount of oxygen charged to the furnace is within the range of 0.02 % to 0.2% by weight of the total charge.

9. The method of claim 1 wherein the amount of boron charged to the furnace is 0.03% to 0.1% of the total charge.

10. The method of claim 1 wherein a portion of the metallic raw materials charged to the furnace is manganese.

11. The method of claim 1 wherein the alloy melted in the induction furnace is an alloy of manganese-copper-nickel.

12. The method of claim 11 wherein said alloy contains approximately 70% to 75% by weight manganese, 15% to 20% by weight copper and 5% to 15% by weight nickel.

* * * * *